United States Patent [19]

Taylor

[11] 4,391,304

[45] Jul. 5, 1983

[54] WARP TENSION STRUCTURE

[75] Inventor: Ray M. Taylor, 1000 Park Ave., Quakertown, Pa. 18951

[73] Assignee: Ray A. Taylor, Quakertown, Pa.

[21] Appl. No.: 254,881

[22] Filed: Apr. 16, 1981

[51] Int. Cl.[3] ..... D03D 49/04; D03D 49/08; F16D 63/00

[52] U.S. Cl. ..... 139/100; 188/83

[58] Field of Search ..... 139/100, 103, 99, 109; 188/83, 166

[56] References Cited

U.S. PATENT DOCUMENTS

| | | | |
|---|---|---|---|
| 1,180,045 | 4/1916 | Keller | 188/83 |
| 1,912,520 | 6/1933 | Gargolinski | 188/83 |
| 2,604,121 | 7/1952 | Taylor | 139/100 |

FOREIGN PATENT DOCUMENTS

| | | | |
|---|---|---|---|
| 206690 | 11/1923 | United Kingdom | 188/83 |

*Primary Examiner*—James Kee Chi

*Attorney, Agent, or Firm*—Harvey B. Jacobson

[57] ABSTRACT

A friction brake band is provided for embracing a loom warp beam head with the ends of the band in spaced relation. One of the band ends includes a roller journaled for rotation about an axis extending transversely of the band end and an elongated anchor cable has one end attached to the other band end, its midportion passed about the roller and its other end stationarily anchored. A flexible tensioner strap is disposed over the brake band and has one end thereof anchored to the aforementioned one end of the band. The other end of the tension strap extends from the side of the head or drum remote from the cable and in a direction generally paralleling the anchored end of the cable and has a variable weight structure operably connected thereto.

8 Claims, 2 Drawing Figures

WARP TENSION STRUCTURE

BACKGROUND OF THE INVENTION

Various forms of warp tension structures heretofore have been designed, such as those disclosed in U.S. Pat. Nos. 1,418,025, 1,500,273, 1,739,323 and those disclosed in my own prior U.S. Pat. Nos. 2,022,577, 2,586,116, 2,604,121, 2,630,141 and 2,777,469. However, although some of these warp tension devices are operative in various degrees of effectiveness, none are able to function as desired and to also eliminate a "tight mark" in the cloth being produced by the associated loom during extended periods of shutdown of the loom. Accordingly, a need exists for a warp tensioning device which will be operative in a superior manner during continued operation of the associated loom and which will also be operable to eliminate the aforementioned "tight mark".

BRIEF DESCRIPTION OF THE INVENTION

The warp tensioning device of the instant invention comprises a friction brake band for embracingly engaging a loom warp beam head or drum with its ends in spaced relation. One end of the brake band carries a roller therefrom journaled for rotation about an axis extending transversely of the brake band and one end of an elongated flexible anchor cable is anchored to the other band end, has its midportion passed about the roller and its other end stationarily anchored relative to the axis of rotation of the beam head or drum. A tension strap is disposed over the band and has one end thereof anchored relative to the aforementioned one end of the band and the other end of the anchor strap extends from the side of the head or drum remote from and in generally the same direction that the other end of the cable extends from the roller to its stationary anchor point. The other tension band end has variable weight structure operatively associated therewith.

The main object of this invention is to provide a warp tension structure which will perform in the desired manner during continued operation of the associated loom and which will also be capable of eliminating a "tight mark" in the cloth being produced by the loom during extended shutdown periods of the loom.

Another object of this invention is to provide a warp tension structure in accordance with the preceding object and which may be readily adapted for use in conjunction with substantially all forms of loom warp beams of the type including suitable heads thereon.

Still another important object of this invention is to provide a warp tension device whose tensioning control may be readily adjusted.

A further object of this invention is to provide an apparatus in accordance with the preceding objects and requiring little maintenance.

Still another object of this invention is to provide a warp tension apparatus whose component parts may be readily replaced when replacement of any parts thereof is required.

A final object of this invention to be specifically enumerated herein is to provide a warp tension device in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a conventional warp beam upon which is wound the warp ends 12 and mounted upon the ends of the warp beam 10 are the usual heads of drums 14 and 16.

Figure 1:
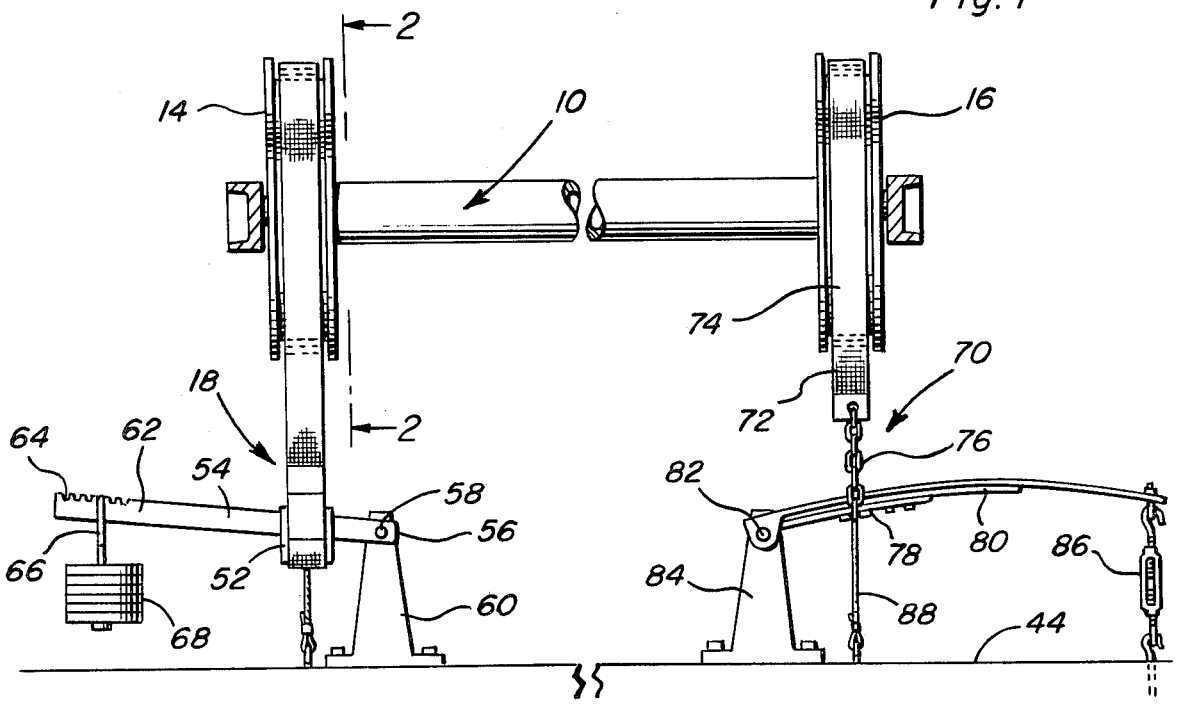
FIG. 1 is a rear elevational view of a warp beam with the beam equipped with opposite end heads and two different forms of warp tensioning devices of the instant invention operatively associated with the heads.
Figure 2:
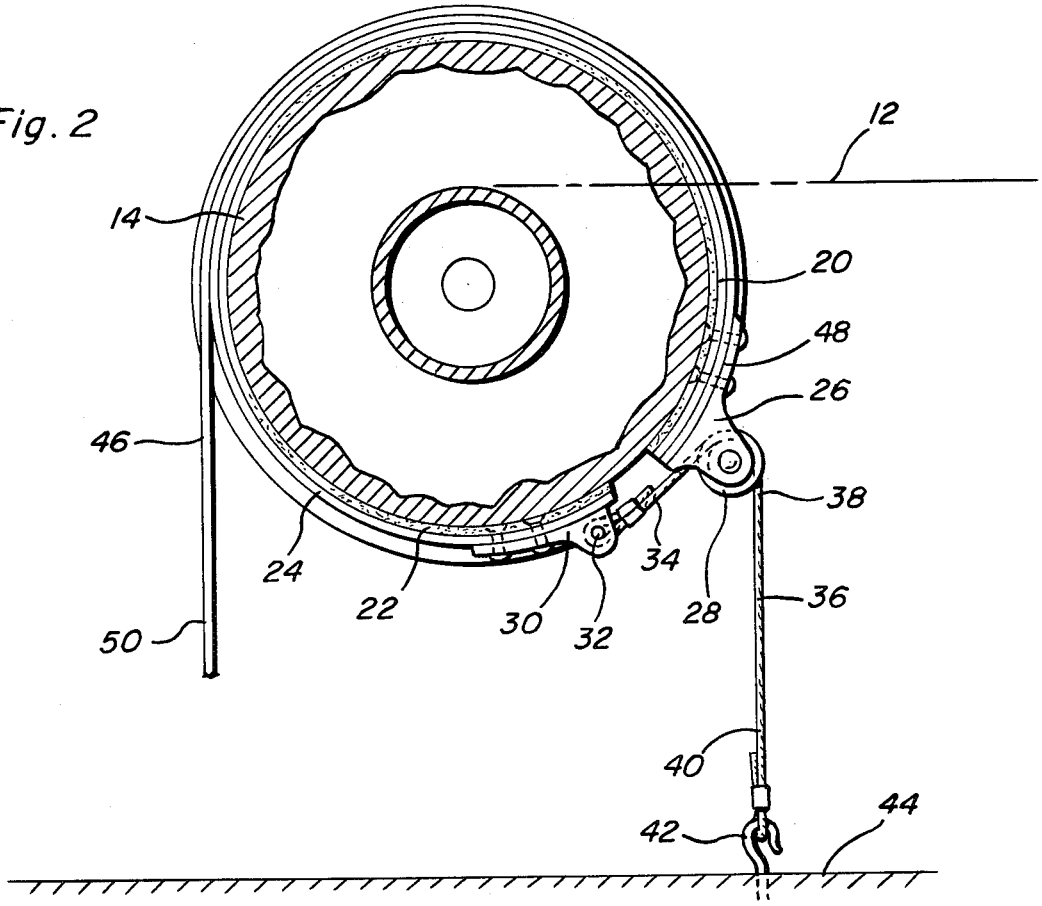
FIG. 2 is an enlarged fragmentary vertical sectional view taken substantially upon the plane indicated by the section line 2—2 of FIG. 1.

A first form of warp tension structure is referred to in general by the reference numeral 18 and is operatively associated with the head 14 at the left side of FIG. 1. The structure 18 comprises a flexible brake band 20 including a flexible gripping ply 22 and an outer mounting ply 24. Corresponding opposite ends of the plies 22 and 24 are secured together and one end of the band 20 has a mount 26 supported therefrom with a roller 28 journed from the mount 26 for rotation about an axis extending transversely of the band 20. The other end of the band 20 includes an anchor structure 30 secured thereto and the anchor structure 30 includes a transverse anchor pin 32 to which one end portion 34 of an elongated flexible anchor cable 36 is secured. A longitudinal midportion 38 of the anchor cable 36 is passed about the roller 28 and the other end portion 40 of the anchor cable 36 is anchored, by an anchor member 42, to a stationary structure 44 such as the floor adjacent the warp beam 10 and relative to which the warp beam 10 is rotatably mounted.

The tension structure 18 further includes a tension band or outer ply 46 having one end 48 anchored relative to the mount 26 and the band 46 extends about the band 20 with its other end extending from the side of the head 14 remote from the mount 26 and in generally the same direction as the other end portion 40 of the anchor cable 36 extends from the roller 28. The other end 50 of the tension band 46 has a bracket 52 supported therefrom and the bracket 52. The other end 50 of the band 46 may be shortened or lengthened as desired upon the bracket 52. The bracket 52 is mounted on the midportion 54 of a lever having one end 56 pivotally supported as at 58 from a floor supported mount 60. The other end 62 of the lever arm 54 is provided with longitudinally spaced notches 64 with which the upper hook end 66 of adjustable weight assembly 68 may be selectively engaged.

With reference now to the right side of FIG. 1, a second form of tension structure referred to in general by the reference numeral 70 may be seen. The tension structure 70 in close operative association with the head 16 is substantially identical to the corresponding portions of the tension structure 18 closely associated with the head 14. The main difference between the structures 70 and 18 is that the other end 72 of the tension band 74 corresponding to the tension band 46 is anchored, through utilization of a link chain 76 to the longitudinal midportion 78 of an elongated leaf spring 80 having one end pivotally supported as at 82 from a floor mounted support 84 and its other end adjustably anchored to the floor 44 through the utilization of a turn buckle 86 whereby the flexure of the spring 80 may be adjusted. The end of the tension band 74 remote from the end 72 thereof is anchored to the floor 44 through the utilization of an elongated flexible anchor cable 88 corresponding to the anchor cable 36.

If a loom operates at 150 picks in a minute and the cloth it is weaving has 75 picks per inch, the tension band on the warp beam head must release 1/75th of an inch 150 times a minute. Because the anchor cables 36 and and 88 are anchored to the floor 44, as the yarn is pulled forward as little as 1/1000th of an inch, the brake pressure applied by the cables 36 and 88 will be immediately released and allow the corresponding brake band to slide. Accordingly, it is extremely important that the anchor cables 36 and 88 be stationarily anchored to the floor or other suitable anchor. With devices such as those disclosed in my prior U.S. Pat. No. 2,630,141 and in U.S. Pat. No. 1,500,273, because the equivalent of the anchor cables 36 and 88 of the instant invention are not positively anchored, the corresponding warp beams may move forward as much as 4, 5 or even more picks and then suddenly slide on the beam head and thereby not provide perfect tension for every pick that the loom makes.

Further, when conventional warp tension structures are used and the associated loom is shutdown for extended periods of time constant stretching of the yarn during the shutdown results in a "tight mark" in the cloth and there is no way to eliminate the "tight mark" when the loom is restarted. With the instant invention, as soon as the loom is shutdown, eight to ten picks back of the pick wheel are released and all of the tension will be released from the cables 36 and 88. Thereafter, when the loom is restarted, the workmen pull up the pick wheel the same eight to ten picks that were previously released thus putting the tension on the tension bands 46 and 74 and allowing the loom to be restarted with absolutely no "tight mark" in the cloth because the yarn was not stretched during shutdown of the loom.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tensioning mechanism for a loom warp beam wherein the beam includes at least one cylindrical head, said mechanism defining a band including a discontinuous inner gripping ply extending about said head and an outer tensioning ply secured to and extending about the inner ply and having adjacent opposite ends, one of said ends including roller means journaled therefrom for rotation about an axis disposed transverse to the longitudinal extent of said one end, an elongated flexible tension member having one end anchored relative to the other end of said tensioning ply and extending therefrom and about said roller means and thereafter generally tangentially of said roller means in a direction generally opposite to the direction in which said tension member extends from said tension ply one end toward said roller means, means non-yieldingly anchoring the other end of said tension member relative to the axis of rotation of said head, said one end of said outer tensioning ply being anchored to the corresponding end of said inner play, the other end of said outer ply extending from the side of said head opposite from the head side from which the other end of said tension member extends toward its anchored position relative to the axis of rotation of said head, said outer ply other end generally paralleling said tension member other end and variable force means oppositely connected to said other end of said outer ply yieldingly biasing said other outer ply end in a direction in which it extends from said head.

2. The combination of claim 1 wherein said variable force means comprises variable weight value gravity weight means.

3. The combination of claim 2 wherein said other end of said outer ply is lengthwise adjustably anchored relative to a a horizontal lever having one end portion pivotally supported for angular displacement about a horizontal axis transverse to said lever arm, said weight means being supported from the other end portion of said lever.

4. The combination of claim 3 wherein said lever arm and weight means include coacting means for adjustable positioning of said weight means longitudinally along said lever.

5. The combination of claim 1 wherein said other end of said outer ply is anchored relative to the midportion of an elongated generally horizontal spring having one end portion pivotally supported for angular displacement about a horizontal axis transverse to said spring means adjustably anchoring the other end portion of said spring away from said beam.

6. A tensioning device for a loom warp beam comprising a friction brake band adapted to embrace a loom warp beam head with its ends in spaced relation, one of said ends having a transverse roller journaled therefrom, one end portion of an elongated flexible anchor member anchored to the other end and having a midportion thereof passed over said roller, the other end of said anchor member being stationarily anchored, a tension band disposed over said friction brake band and having one end thereof anchored relative to said friction brake band one end, the other end of said tension band extending from the side of said head remote from said one end of said brake band and in generally the same direction as the other end of said tension band extends from said roller, and adjustable value force means operably connected to said other end of said tension band and yieldingly biasing said tension band other end in the direction in which it extends from said head.

7. The combination of claim 6 wherein said adjustable value force means comprises variable weight value gravity weight means.

8. The combination of claim 6 wherein said adjustable value force means includes an adjustably flexed leaf spring.

* * * * *